US007963708B1

(12) United States Patent
Shamir et al.

(10) Patent No.: US 7,963,708 B1
(45) Date of Patent: Jun. 21, 2011

(54) MINIMIZE CARBONIZATION OF DEVELOPER LIQUID

(75) Inventors: Kalman Shamir, Herzlia (IL); Moshe Marom, Kfar Saba (IL)

(73) Assignee: Eastman Kodak Company, Rochester, NY (US)

( * ) Notice: Subject to any disclaimer, the term of this patent is extended or adjusted under 35 U.S.C. 154(b) by 17 days.

(21) Appl. No.: 12/632,860

(22) Filed: Dec. 8, 2009

(51) Int. Cl.
*G03D 3/02* (2006.01)

(52) U.S. Cl. ..... 396/626

(58) Field of Classification Search ..... 396/564, 396/626

See application file for complete search history.

(56) References Cited

U.S. PATENT DOCUMENTS

| | | | | |
|---|---|---|---|---|
| 3,774,521 | A * | 11/1973 | Beck | 396/609 |
| 6,149,320 | A * | 11/2000 | Ichikawa et al. | 396/564 |
| 7,024,996 | B2 * | 4/2006 | Sasayama | 101/463.1 |
| 7,153,045 | B2 * | 12/2006 | Ginther | 396/626 |
| 7,854,558 | B2 * | 12/2010 | Marom et al. | 396/578 |

* cited by examiner

*Primary Examiner* — W. B. Perkey
(74) *Attorney, Agent, or Firm* — Nelson Adrian Blish

(57) ABSTRACT

An apparatus designed to minimize carbonization of developer liquid within a printing plate developer device (100). The apparatus includes, at least one open tank (204, 220) containing developer waste (148) positioned in proximity to plate developer tank (104) inside the developer device, and a replenishment element (212). The replenishment element is configured to replenish the at least one open tank with a developer waste. The developer waste and the air trapped (132) in proximity to the printing plate developer tank will generate a carbonization reaction.

4 Claims, 3 Drawing Sheets

MINIMIZE CARBONIZATION OF DEVELOPER LIQUID

CROSS REFERENCE TO RELATED APPLICATIONS

Reference is made to commonly-assigned copending U.S. patent application Ser. No. 12/371,667, filed Feb. 16, 2009, entitled DEVELOPER WASTE REUSE, by Marom et al., the disclosure of which is incorporated herein.

FIELD OF THE INVENTION

This present invention relates to an apparatus and method for reducing carbonization of developer liquid in a plate developer.

BACKGROUND OF THE INVENTION

Printing plates are imaged on special opto-mechanical plate setters. The imaged plates undergo a chemical development process which is usually performed by a plate developing device 100 shown in FIG. 1A. The development process uses chemical development material in a liquid form 108. The material contained a developer tank 104 within the plate developer device 100, as is shown in FIG. 1B.

During the filling of the developer tank with developer liquid 108, air 132 may cause carbonization of liquid 108. The carbonization of the developer liquid results in degraded performance of the plate developing process. The intention of this invention is to prevent, or substantially reduce, the carbonization of the developer liquid inside the plate developing machinery.

SUMMARY OF THE INVENTION

Briefly, according to one aspect of the present invention an apparatus minimizes carbonization of developer liquid within a printing plate developer device.

The apparatus includes at least one open tank containing developer waste positioned in proximity to a plate developer tank inside a developer device, and a replenishment element. The replenishment element is configured to replenish at least one open tank with developer waste. The developer waste traps air in proximity to the printing plate developer tank. The waste developer generates a carbonization reaction and prevents or reduces carbonization of developer liquid in the developer tank.

These and other objects, features, and advantages of the present invention will become apparent to those skilled in the art upon a reading of the following detailed description when taken in conjunction with the drawings wherein there is shown and described an illustrative embodiment of the invention

DETAILED DESCRIPTION OF THE INVENTION

Figure 1A:
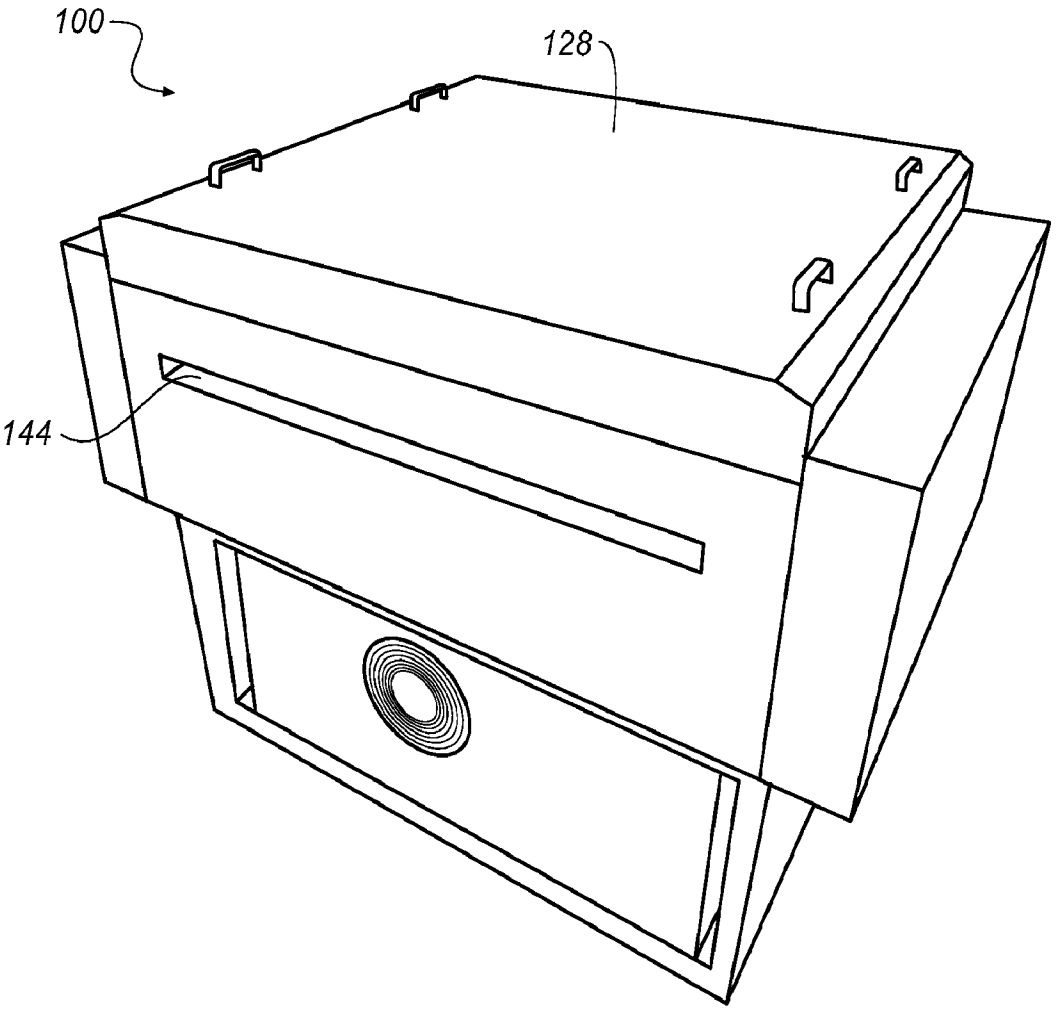
FIG. 1A (PRIOR ART)
FIG. 1A shows a prior art perspective view of a plate developer.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

Figure 1B:
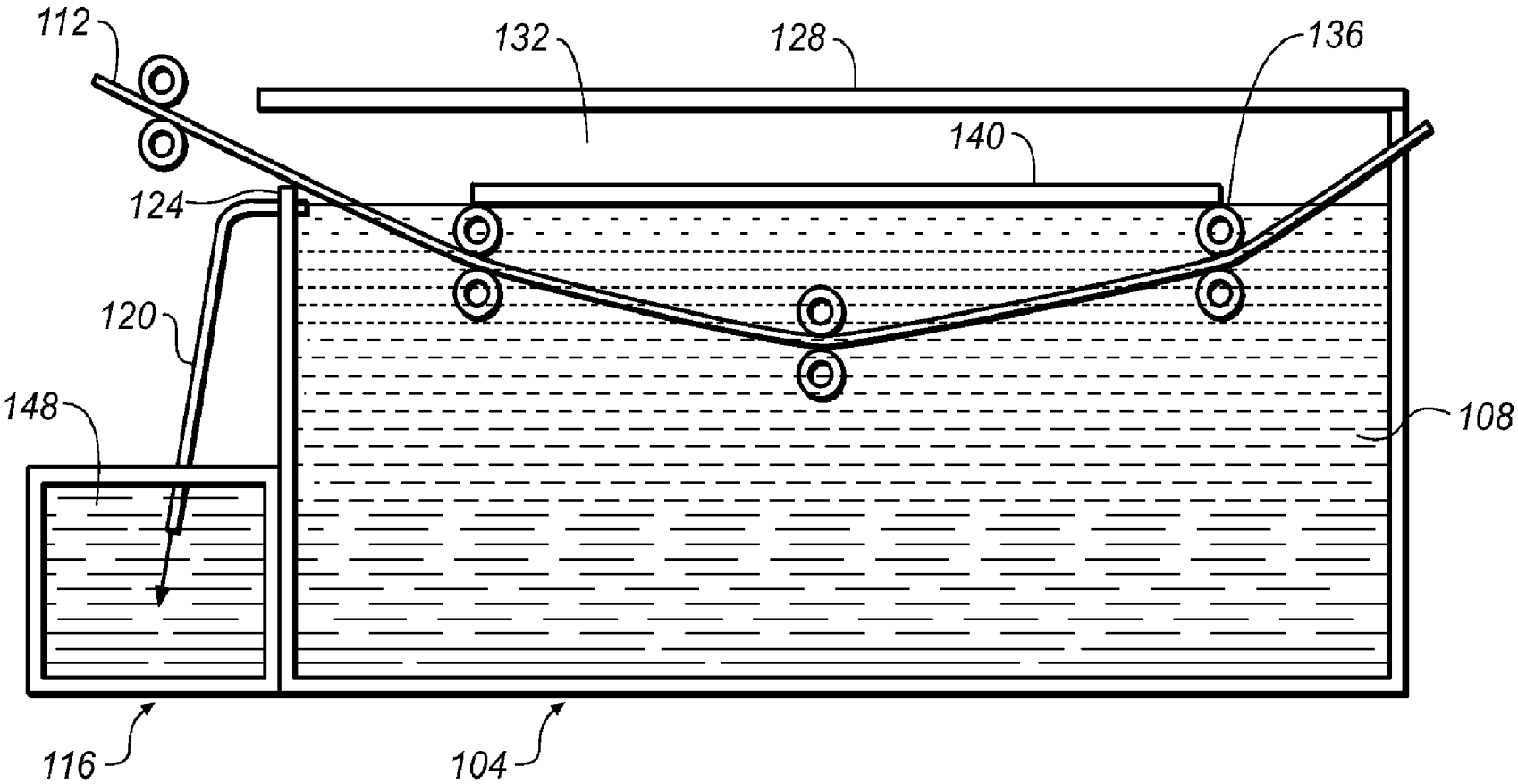
FIG. 1B (PRIOR ART)
FIG. 1B is a prior art schematic cross section illustrating a prior art plate developer in operation.

FIG. 1B shows a schematic illustration of plate developer device 100 in operation. Printing plate 112 is inserted via plate inlet 144 into developer 100. Printing plate 112 is then transported into plate developer device 100 between pluralities of pairs of rollers 136. Printing plate 112 is immersed into plate developer tank 104, which is filled with plate developer liquid 108, for plate processing. The plate developer liquid 108 in plate developer tank 104 when is exposed to air tends to carbonize. Carbonization reduces the processing efficiency of the developer; therefore it is desirable to minimize carbonization in plate developer device 100. Carbonization can be reduced by reducing the surface area of the plate developer liquid 108 which exposed to air 132. FIG. 1B shows a top cover 128 used in plate developer device 100, which helps to reduce plate developer liquid 108 contact with air. In addition a dedicated anti-carbonation cover 140 may be installed at over plate developer liquid 108, covering most of the plate developer liquid 108 open area, thus minimizing contact with air 132.

The carbonization of the plate developer liquid 108 occurs in the open areas of plate developer tank 104 top surface. Portions of plate developer liquid 108 are spilled over from the top surface spill over barrier 124 via conduit 120 into waste liquid tank 116. Fresh portions of plate developer liquid 108 will be replenished into plate developer tank 104, to compensate for the wasted liquid portions.

Figure 2:
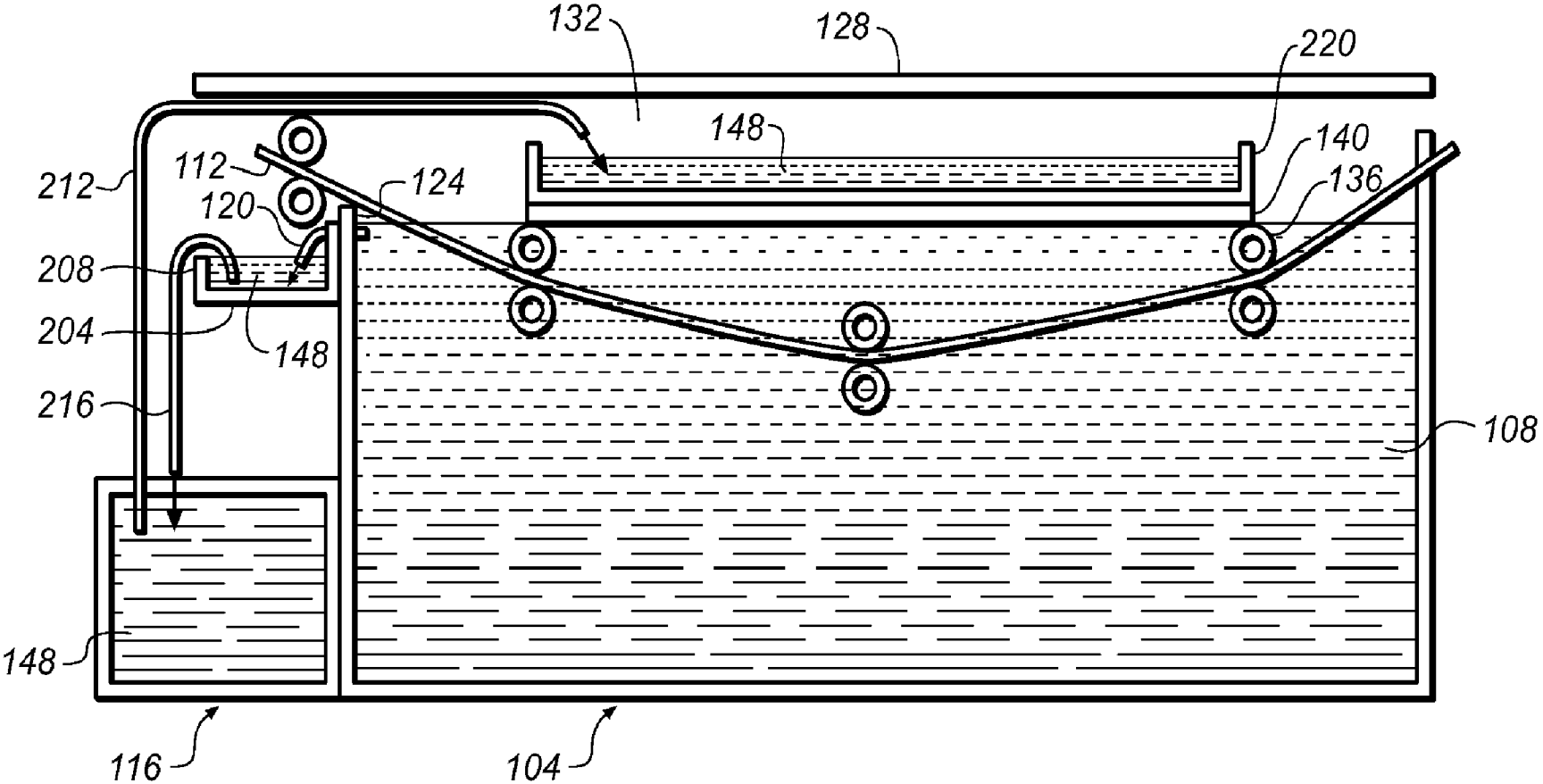
FIG. 2 is a cross section schematic showing a plate developer according to the present invention.

FIG. 2 shows an embodiment of the present invention. Open containers (204, 220) filled with developer waste 148 are 204 placed inside developer 100. The open containers (204, 220) are installed in proximity to areas where air 132 might interact with plate developer liquid 108. This will increase the likelihood of air 132 to interact with developer waste 148 instead of with plate developer liquid 108, thus minimizing carbonization of fresh plate developer liquid 108.

Open containers 204 are filled with developer waste 148 directly from plate developer tank 104 when liquid is spilled over barrier 124 into open container 204. Spilled over developer waste liquid 148 may spill over barrier 208 from open container 204 trough spill over conduit 216 into waste liquid tank 116.

Open containers 220 may be placed directly over the top surface of plate developer liquid 108 where developer waste 148 is replenished into open container 220 through replenishment conduit 212 from waste liquid tank 116.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

It will be appreciated by persons skilled in the art that the present invention is not limited to what has been particularly shown and described hereinabove. Rather the scope of the present invention is defined by the appended claims and includes both combinations and sub-combinations of the various features described hereinabove as well as variations and modifications thereof, which would occur to persons skilled in the art upon reading the foregoing description.

PARTS LIST

100 plate developer device
104 plate developer tank

108 plate developer liquid
112 printing plate
116 waste liquid tank
120 waste spill over conduit
124 waste spill over barrier/level
128 top cover
132 air in plate developer
136 rollers
140 anti carbonization cover
144 plate inlet
148 developer waste
204 open container
208 spill over barrier/level
212 replenishment conduit
216 spill over conduit
220 open container

The invention claimed is:

1. An apparatus for minimizing carbonization of developer liquid in a printing plate developer device comprising:

a plate developer tank containing developer liquid for developing printing plates;

at least one open tank containing developer waste positioned in proximity to said plate developer tank for minimizing carbonization of said developer liquid;

a waste liquid tank for holding developer waste liquid; and a replenishment element configured to replenish said at least one open tank with developer waste liquid.

2. The apparatus according to claim 1 wherein said developer waste liquid in said at least one open tank traps air in proximity of said printing plate developer tank.

3. The apparatus according to claim 2 wherein air is trapped by a carbonization reaction.

4. The apparatus according to claim 1 wherein a second open tank filled with said developer waste liquid is positioned in proximity to said plate developer tank.

* * * * *